US009683805B2

(12) United States Patent
Wynalda, Jr.

(10) Patent No.: US 9,683,805 B2
(45) Date of Patent: Jun. 20, 2017

(54) BALLISTIC INFORMATION TAG FOR WEAPON AND METHOD

(71) Applicant: Fourth Arrow, LLC, Comstock Park, MI (US)

(72) Inventor: Robert M. Wynalda, Jr., Comstock Park, MI (US)

(73) Assignee: Fourth Arrow, LLC, Comstock Park, MI (US)

( * ) Notice: Subject to any disclaimer, the term of this patent is extended or adjusted under 35 U.S.C. 154(b) by 0 days.

(21) Appl. No.: 14/964,037

(22) Filed: Dec. 9, 2015

(65) Prior Publication Data

US 2016/0161205 A1 Jun. 9, 2016

Related U.S. Application Data

(60) Provisional application No. 62/089,699, filed on Dec. 9, 2014, provisional application No. 62/100,372, filed (Continued)

(51) Int. Cl.
*F41A 35/00* (2006.01)
*G06Q 90/00* (2006.01)

(Continued)

(52) U.S. Cl.
CPC ..... *F41A 35/00* (2013.01); *B42D 15/00* (2013.01); *G06Q 90/00* (2013.01); *G09F 3/005* (2013.01); *G09F 3/04* (2013.01); *G09F 23/00* (2013.01)

(58) Field of Classification Search
CPC ..... G09F 3/00; G09F 3/005; G06Q 90/00; B42D 15/0073; B42D 15/00; F41A 35/00; F41A 99/00

(Continued)

(56) References Cited

U.S. PATENT DOCUMENTS

D242,141 S 11/1976 Sullivan
D262,567 S 1/1982 Hillberg (Continued)

FOREIGN PATENT DOCUMENTS

DE 202011107796 U1 12/2011

OTHER PUBLICATIONS http://forum.snipershide.info/showthread.php?t=20676 Jun. 2009.*

(Continued)

*Primary Examiner* — John D Cooper
(74) *Attorney, Agent, or Firm* — Zollinger & Burleson Ltd.

(57) ABSTRACT

A tag in the form of a band provides ballistic information for rifle ammunition or flight or sight information for arrows. The band is selectively attachable to the weapon such that the ballistic information is readily available to the user of the weapon and the band can be removed and used again on the same or a different weapon. The band can wrap around a portion of the weapon and be held by friction or a combination of friction and compressive force. The band can be elastic and stretch over the stock of a rifle or shotgun, the grip of a handgun, the stock of a cross bow, or a counterweight on a compound bow. The disclosure also provides a method for providing the ballistic information to the user of the weapon through the band that is selectively attachable to the weapon. The band can be provided with the container of ammunition at the time of purchase.

7 Claims, 5 Drawing Sheets

Related U.S. Application Data on Jan. 6, 2015, provisional application No. 62/104,562, filed on Jan. 16, 2015.

(51) Int. Cl.

| | |
|---|---|
| ***B42D 15/00*** | (2006.01) |
| ***G09F 3/00*** | (2006.01) |
| ***G09F 23/00*** | (2006.01) |
| ***G09F 3/04*** | (2006.01) |

(58) Field of Classification Search

USPC ..... 42/1.01, 74; 63/5.1

See application file for complete search history.

(56) References Cited

U.S. PATENT DOCUMENTS

| | | | | |
|---|---|---|---|---|
| 5,265,365 | A * | 11/1993 | Finn | F41C 23/00 224/239 |
| 5,546,691 | A * | 8/1996 | Allison | F41C 27/00 42/111 |
| 5,718,010 | A * | 2/1998 | Beier | G09F 3/10 40/638 |
| D454,610 | S | 3/2002 | McCarthy | |
| 6,374,719 | B1 * | 4/2002 | Phillips | F42B 39/02 206/3 |
| 6,845,532 | B1 * | 1/2005 | Rosenblum | A47C 27/008 40/661 |
| D540,709 | S | 4/2007 | Daas | |
| D542,167 | S | 5/2007 | Brown | |
| D542,687 | S | 5/2007 | Brown | |
| D542,689 | S | 5/2007 | Daas | |
| D543,127 | S | 5/2007 | Daas | |
| D546,225 | S | 7/2007 | Brown | |
| D546,226 | S | 7/2007 | Brown | |
| D546,227 | S | 7/2007 | Brown | |
| D591,633 | S | 5/2009 | Del Valle | |
| D600,571 | S | 9/2009 | Singer | |
| D611,819 | S | 3/2010 | Slubski | |
| 8,567,103 | B2 | 10/2013 | Wolf | |
| 8,650,793 | B1 * | 2/2014 | Mendez | F41G 11/003 42/90 |
| 2009/0049731 | A1 | 2/2009 | Seuk | |
| 2009/0094870 | A1 * | 4/2009 | Isserow | G09F 3/04 40/306 |
| 2010/0186274 | A1 * | 7/2010 | Diehl | G09F 3/00 40/638 |
| 2010/0285283 | A1 * | 11/2010 | Kingsbury | A42B 1/004 428/195.1 |
| 2011/0290872 | A1 | 12/2011 | Bock | |
| 2013/0221652 | A1 * | 8/2013 | Wilson | A43B 23/24 283/62 |
| 2014/0020427 | A1 * | 1/2014 | Wolf | A44C 5/0069 63/5.1 |
| 2015/0253107 | A1 * | 9/2015 | Hamilton | F41G 1/383 42/111 |

OTHER PUBLICATIONS http://www.horusvision.com/news.php?article=32 Aug. 2008.* http://forum.snipershide.info/showthread.php?t=58176 Aug. 2010.* https://www.wristbandbros.com/articles/2013/08/20/dual-layer-silicone-wristbands Aug. 20, 2013.*

Hornady Ballistic band (2-Pack); Copyright 2015; accessed from www.hornady.com Dec. 9, 2015.

* cited by examiner

BALLISTIC INFORMATION TAG FOR WEAPON AND METHOD

CROSS REFERENCE TO RELATED APPLICATIONS

This application claims the benefit of U.S. provisional patent applications 62/089,699, filed Dec. 9, 2014; 62/100,372 filed Jan. 6, 2015, and 62/104,562 filed Jan. 16, 2015; the disclosures of each are incorporated herein by reference.

BACKGROUND OF THE DISCLOSURE

1. Technical Field

The disclosure relates to weapons such as firearms and ammunition as well as bows and arrows. More particularly, the disclosure relates to a tag in the form of an information band that provides ballistic information for firearm ammunition or flight or sight information for arrows or bolts. The information band is selectively attachable to the weapon such that the ballistic information is readily available to the user of the weapon and the band can be removed and used again on the same or a different weapon. The disclosure also provides a method for providing the ballistic information to the user of the weapon through the band that is selectively attachable to the weapon.

2. Background Information

Rifle scopes must be zeroed to a certain distance for a specified cartridge, load, and bullet. Manufacturers publish ballistic information for their ammunition products. The published ballistic information includes a trajectory table (based on a given barrel length) that includes a zero assigned to a specified distance and a drop (or rise) distance assigned to a series of other distances. The drop and rise distances can differ significantly for different loads and different bullet weights.

Hunters needing to make a precise shot need to know the bullet drop or bullet rise for a given distance. When a hunter uses multiple rifles and different loads, the specific numbers can be hard to remember. Some hunters write the ballistic information on masking tape and stick the tape to the rifle.

Arrows travel along an arc and thus have drop distances for different lengths of flight. Hunters needing to make a precise shot need to know the drop of the arrow associated with the shot. The shot will include a distance and a height such as when the hunter is shooting from a stand. A bow may include a sight which has different reference points for different shot lengths.

SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A tag in the form of a band provides ballistic information for rifle ammunition or flight or sight information for arrows. The band is selectively attachable to the weapon such that the ballistic information is readily available to the user of the weapon and the band can be removed and used again on the same or a different weapon. The band can wrap around a portion of the weapon and be held by friction or a combination of friction and compressive force. The band can be elastic and be stretched over the stock of a rifle or shotgun, the grip of a handgun, the stock of a cross bow, or a counterweight on a compound bow.

The disclosure also provides a method for providing the ballistic information to the user of the weapon through the band that is selectively attachable to the weapon. The band can be provided with the container of ammunition at the time of purchase.

The user of the weapon connects the band to the weapon that is using the ammunition for ready access to the ballistic information during a hunt. The band can be connected to the weapon by stretching the band, placing the stretched band over a portion of the weapon, and relaxing the band so that it compressively attaches itself to the portion of the weapon.

The disclosure also provides a method of associating ballistics information with a weapon wherein the user of the weapon writes the ballistics information on a band that is connected to the weapon such that the ballistics information is visible.

BRIEF DESCRIPTION OF THE DRAWINGS

Similar numbers refer to similar parts through the specification.

DETAILED DESCRIPTION OF THE DISCLOSURE

Figure 1B:
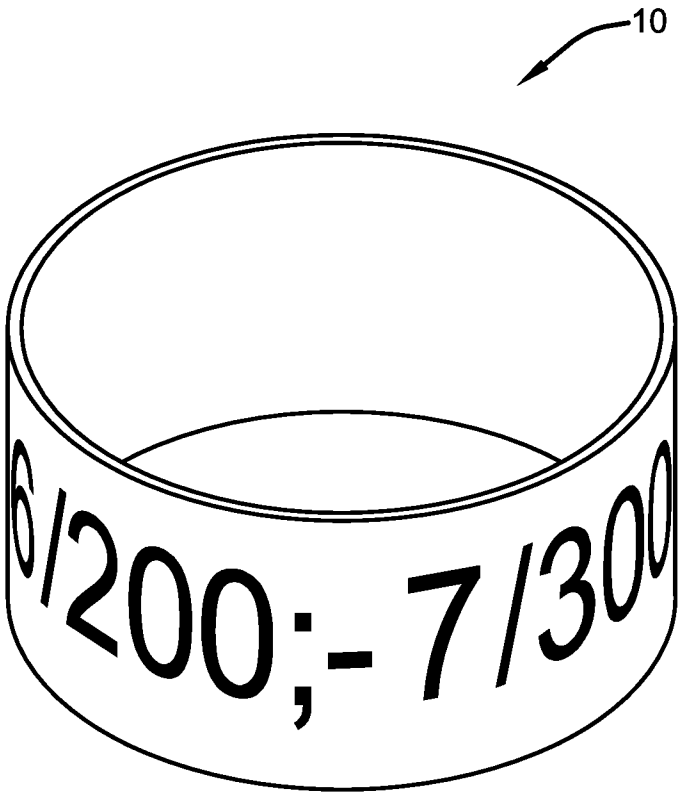
FIG. 1B is a perspective view of a second exemplary configuration for the band of the disclosure.
Figure 1A:
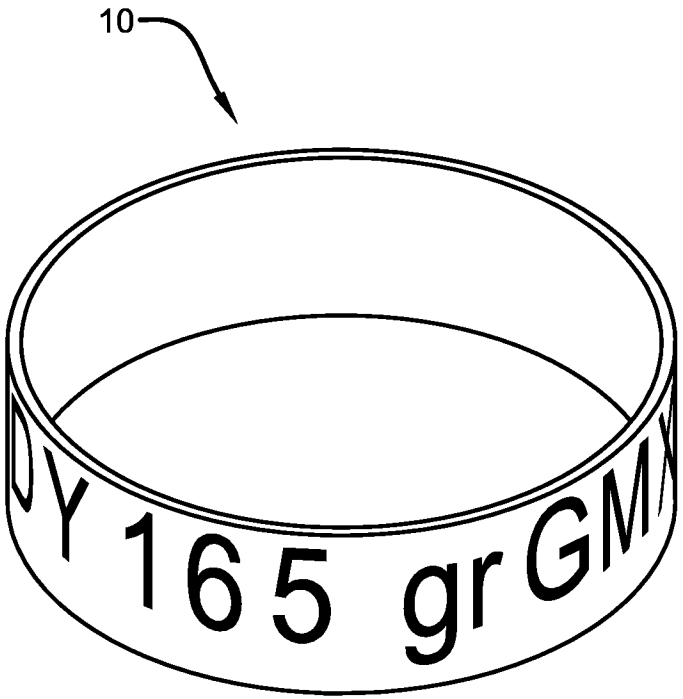
FIG. 1A is a perspective view of a first exemplary configuration for the band of the disclosure.
Figure 2:
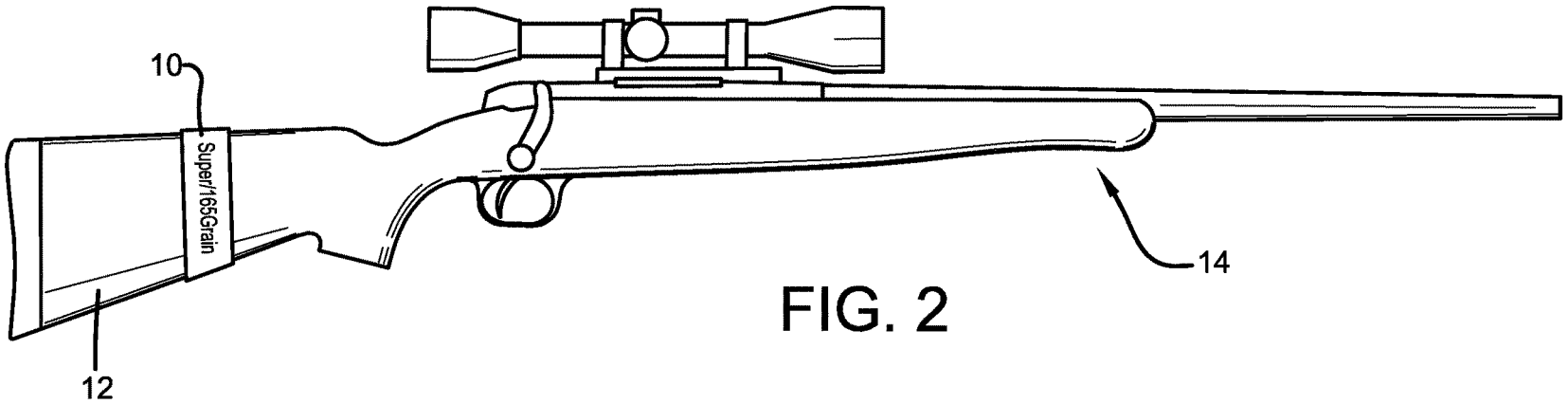
FIG. 2 is a side view of an exemplary firearm with one of the bands of the disclosure carried by the stock of the firearm.

A band, generally referred to by the reference numeral 10 in the accompanying drawings, can be provided with a box of ammunition (FIG. 3) with ballistic information provided on the elastic band matching the ballistic information for the ammunition in the box. Band 10 also can be provided with distances and blanks to allow the user to write in ballistic information specific to the weapon with which the ammunition will be used. Band 10 is used as a tag to keep the ballistic information with the firearm 14 using the ammunition. The ballistic information can be a variety of information such as the description of the ammunition, the velocity, the energy, and/or the trajectory table. The description of the ammunition and the trajectory table are the most useful information for the hunter. An example of the information may be "Brand Name" "Product Type" "Grain Load" and a plurality of trajectory data points. The trajectory information can appear as a rise or drop number paired with a target distance. For example, a series of numbers such as 1.6/100; 0/200; −7/300; −20/400 tell the user that the ammunition is zeroed at a 200 yard distance and will drop 7 inches at 300 yards and will drop 20 inches at 400 yards. The rise or drop data can be added to band 10 by the user for a specific weapon.

Band 10 also can be used with a crossbow or bow to keep the flight information of an arrow or bolt on hand for a hunter or target shooter. Band 10 can reference which sight marking should be used with different distances. Band 10 can be connected to the stock of a cross bow, the counterweight of a compound bow, or other locations where the band will not interfere with the operation of the weapon.

Figure 3:
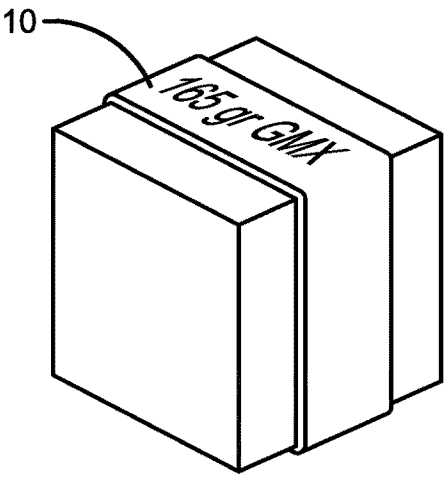
FIG. 3 is a perspective view of one of the bands of the disclosure
Figure 4:
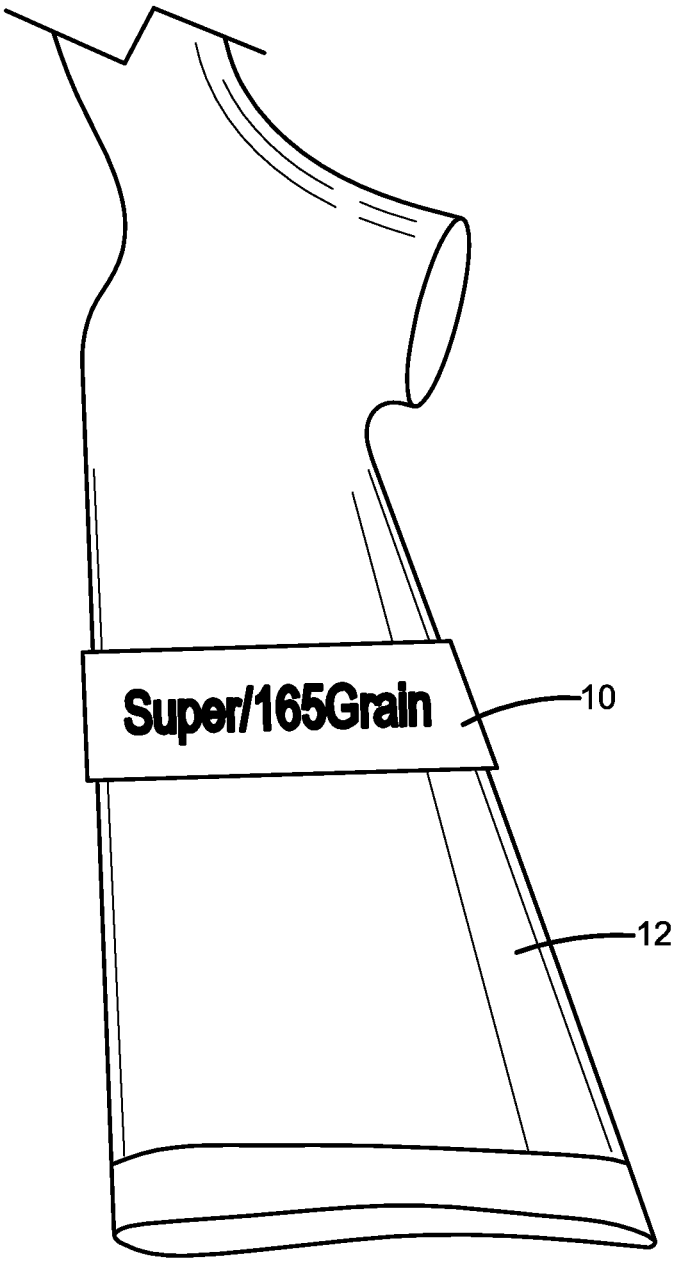
FIG. 4 is a perspective view of one of the bands carried by the stock of a firearm.
Figure 5:
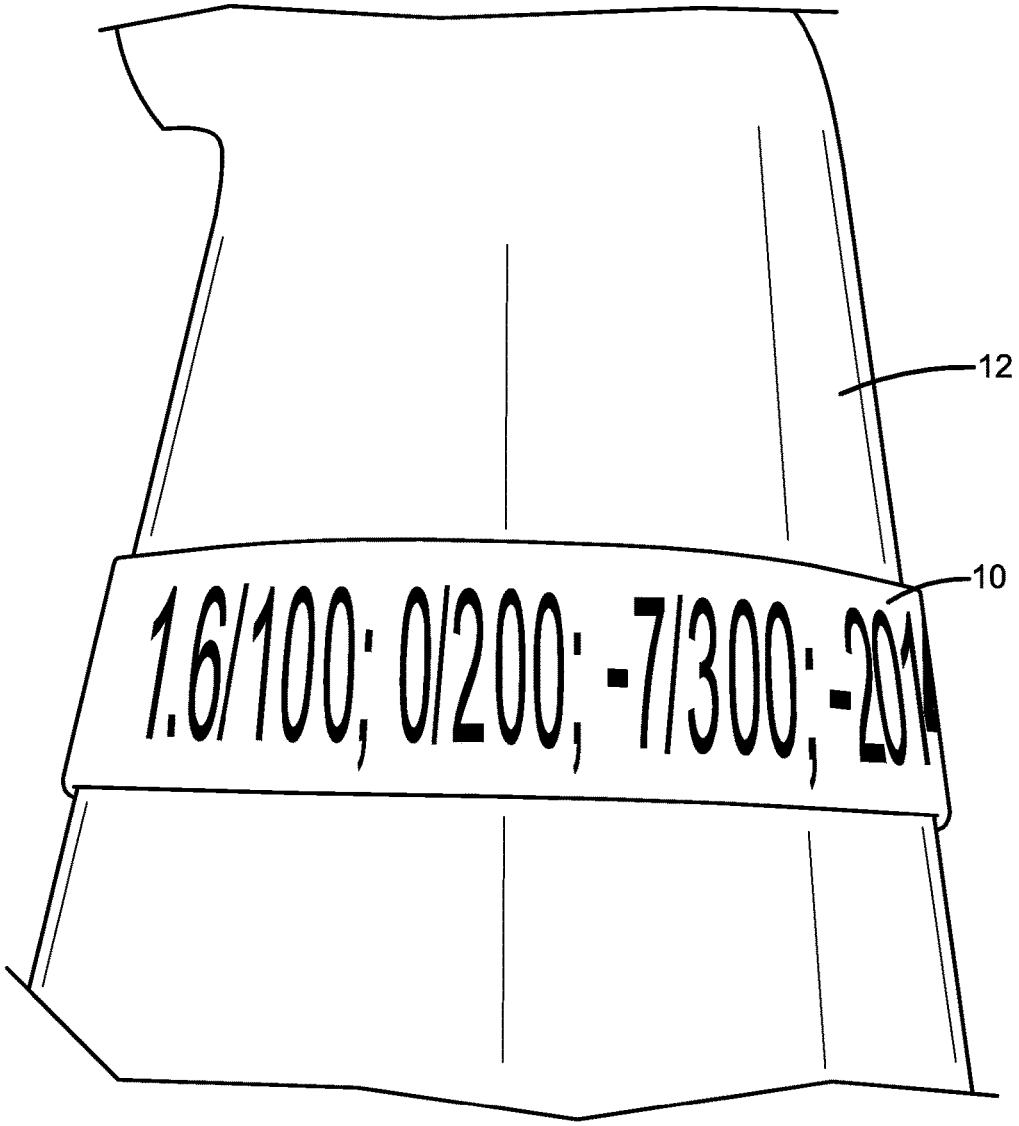
FIG. 5 is a perspective view of the other side of the band of FIG. 4.

Bands 10 having the ballistic information can be included with a box of ammunition as shown in FIG. 3. Bands 10 can be disposed around the box or disposed within the box. The user thus has an easy way to reference the ballistic information when loading the firearm. Band 10 can be removed from the box of ammunition and placed around the stock 12 of the user's firearm 14 so the information is immediately on hand while the firearm 14 is in use. Band 10 can be placed anywhere on the firearm, whether it be the stock, scope or barrel. Band 10 can then be removed when different ammunition is used with firearm 14 and reused at another time with the same or a different firearm. In this application, the term firearm includes rifles, shotguns, and handguns.

Band 10 can be made out of any type of material that displays information. Examples of the material include: rubber, latex, silicone rubber, and fabric with a latch (such as a hook-and-loop fastener latch). Bands 10 are configured to be secured to the weapon (firearm or bow) with a compressive force that holds band 10 in place or with a combination of compressive force and friction. The friction is sufficient to prevent the band from slipping down a tapered stock. The compressive force can be created by using an elastic material for band 10.

An exemplary configuration of band 10 uses an elastic material to form the body of the band and to create the compressive holding force that secures the band to the firearm. Elastic bands 10 are resilient and tough, but soft so that it does not scratch a wood stock or the coating on a wood stock on a typical firearm 14 or crossbow. Any of a variety of rubber, polymer, or elastomeric materials can be used. Silicone rubber is one example. The material can be waterproof and the information provided on the band can be waterproof. The band 10 can be stretched to about twice its length. When resting and opened to a circular configuration, band 10 has a diameter of 2-3 inches. Band 10 can be stretched open over a firearm stock having a height dimension of about four to eight inches. Bands 10 also can be provided in forms that expand to a greater degree if a material with more stretch is desired. The information can be printed in a manner that is readable when the band is stretched such that the information may be printed close together in a narrow font when the band is resting. One example is a band 10 having a circumference of about 180 mm and a width of about 20 mm with a thickness of about 2 mm.

The information provided on band 10 can be printed on the material of band 10 in an ink. Other configurations are provided wherein multiple layer polymers are used to form band 10 with the layers provided in contrasting colors. One layer is removed in the shape of the information to expose the other layer. These multiple layer bands are useful because they are durable. Another configuration provides raised polymer numbers disposed on a polymer background. The information may be provided in a bright color against a dark background. For example, band 10 can be formed with an inner layer of red material and an outer layer of black material. Portions of the black material are removed to expose the red material. The removed portions define the letters and numbers of the information.

Figure 6:
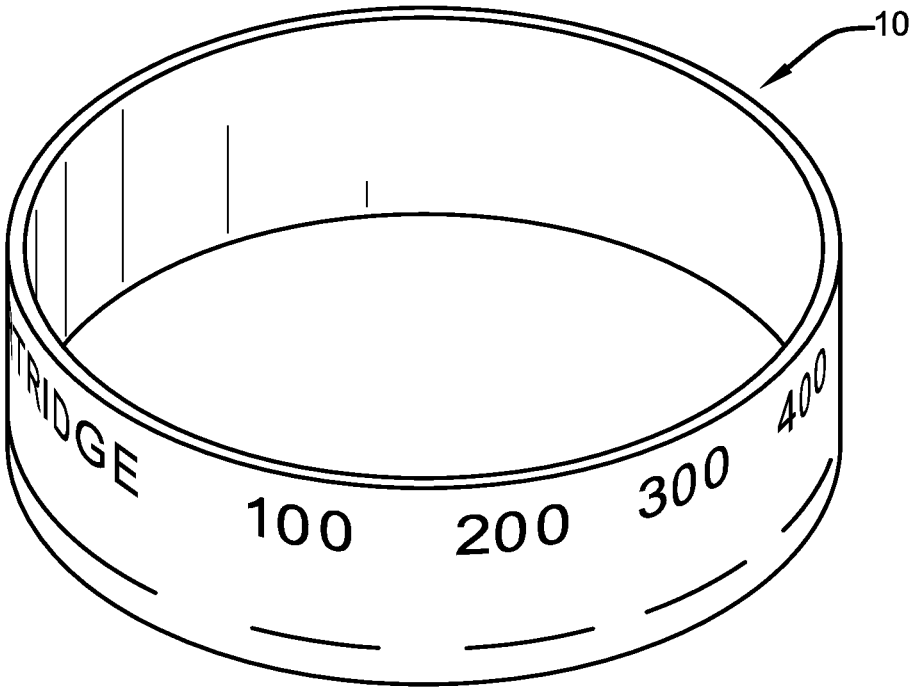
FIG. 6 is a perspective view of an exemplary configuration wherein blank spaces are provided adjacent distances so that the user can add ballistic information to the band.

In another configuration, band 10 is generic so that a user can write their own information onto the band 10. The user can identify trajectory information specific to his weapon and a specific ammunition or arrow and then write this information directly onto band 10. Band 10 will allow the customer to record: Ballistics; Trajectory; Identification of the weapon; and/or Ownership identification. When used with a bow, band 10 allows the user to record arrow drop for different distances. Band 10 also can be configured to allow the user to record drop information for different reference marks on a bow sight. In these configurations, band 10 defines areas for each item of information to be added to band 10. In these configurations, band 10 has a writable surface adapted to receive a marking material such as an ink from a ballpoint pen or an indelible marker. Any elastic material that receives a mark from an indelible marker such that the mark is generally waterproof after it dries can be used for band 10. A coated silicone rubber can be used. The writing areas may be defined with permanent markings such as described above with the different materials such that the markings added by the user can be removed without removing the markings that define the writing areas. One example shown in FIG. 6 provides a plurality of yardages with spaces next to each yardage wherein the user can record the specific trajectory for a specific firearm when a specific ammunition is used with that firearm. Another example provides a plurality of yardages with spaces next to each yardage wherein the user records the arrow drop for a level shot or a shot from a deer stand. A further example provides a plurality of sight identifications so the user can record information related to each sight marking. A combination of yardages and sight markings can be provided on a single band along with entries for both level shots and shots of downward trajectories.

The interior surface can be used to support the name of retail establishment or as an advertisement.

The bands can be added to the weapon and removed. The bands can be worn on the shooter's wrist.

An exemplary method of using a band includes the steps of identifying which ammunition or arrow is going to be used with the weapon and identifying the trajectory information for that ammunition or arrow as used with a specific weapon. The user then marks the trajectory information or sight information onto the band. The band is then added to the weapon. The adding of the band can be done be stretching the band over the butt end of the stock and placing the partially stretched band at a location of the stock wherein the elasticity or resiliency of the band creates a compressive force which holds the band on the stock of the weapon. The trajectory information can be located to face away from the users face so that it can be referenced quickly by the user's dominate eye.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the descriptions and illustrations of the exemplary configurations are examples and the claimed invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A weapon tag configured to provide ballistic information to a user of a weapon; the tag comprising:

a continuous elastic band having an inner surface and an outer surface; the outer surface including ballistic information related to the weapon and an ammunition; the ballistic information including a plurality of distances and the outer surface of the band providing a blank space associated with each distance such that the user of the band is able to write trajectory information specific to the weapon and ammunition adjacent the relevant distance.

2. The tag of claim 1, where the elastic band includes inner and outer layers of polymer; the outer layer defining openings in the shape of the ballistic information to allow the inner layer to be viewed through the outer layer.

3. The tag of claim 1, wherein the elastic band has a circumference of seven inches.

4. The tag of claim 3, wherein the elastic band has a width of 0.75 inches.

5. A method of associating ballistics information with a weapon comprising the steps of:

providing an elastic band having an outer surface; the outer surface including a plurality of distances and a blank space associated with each distance;

selecting ammunition for the weapon;

identifying the trajectory information for the ammunition for at least some of the plurality of distances appearing on the outer surface of the elastic band;

adding the ballistic information to the outer surface in the blank space adjacent the distance; and connecting the elastic band to the weapon with the ballistic information visible.

6. The method of claim 5, wherein the weapon includes a shoulder stock and further comprising the step of stretching the elastic band open and placing the elastic band onto a portion of the shoulder stock such that the elastic band is held with a compressive force.

7. The method of claim 5, further comprising the steps of identifying the ballistic information for the ammunition for each of the plurality of distances appearing on the outer surface of the elastic band; and adding the ballistic information to the outer surface in the blank space adjacent each of the distances.

* * * * *